US008434995B2

(12) United States Patent
Pool et al.

(10) Patent No.: US 8,434,995 B2
(45) Date of Patent: May 7, 2013

(54) DUCT WALL FOR A FAN OF A GAS TURBINE ENGINE

(75) Inventors: Clare L. Pool, Derby (GB); Kenneth F. Udall, Ilkeston (GB); Richard G. Stretton, Loughborough (GB); Julian M. Reed, Derby (GB)

(73) Assignee: Rolls-Royce PLC, London (GB)

( * ) Notice: Subject to any disclaimer, the term of this patent is extended or adjusted under 35 U.S.C. 154(b) by 424 days.

(21) Appl. No.: 12/768,316

(22) Filed: Apr. 27, 2010

(65) Prior Publication Data

US 2010/0284790 A1 Nov. 11, 2010

(30) Foreign Application Priority Data

May 5, 2009 (GB) ..... 0907582.1

(51) Int. Cl.
*F01D 21/00* (2006.01)

(52) U.S. Cl.
USPC ..... 415/9; 415/200; 415/214.1

(58) Field of Classification Search ..... 415/9, 119, 415/173.4, 200, 214.1
See application file for complete search history.

(56) References Cited

U.S. PATENT DOCUMENTS

| | | | | |
|---|---|---|---|---|
| 4,484,856 | A * | 11/1984 | Patacca | 415/9 |
| 4,718,818 | A | 1/1988 | Premont | |
| 4,934,899 | A | 6/1990 | Patacca | |
| 5,267,828 | A | 12/1993 | Lenhart et al. | |
| 6,638,008 | B2 * | 10/2003 | Sathianathan et al. | 415/9 |
| 7,753,643 | B2 * | 7/2010 | Gonzalez et al. | 415/1 |
| 2005/0269443 | A1 | 12/2005 | Porte | |
| 2006/0292002 | A1 * | 12/2006 | Sathianathan | 415/173.3 |

FOREIGN PATENT DOCUMENTS

| | | | |
|---|---|---|---|
| EP | 0 030 179 | A1 | 6/1981 |
| EP | 1 596 037 | A2 | 11/2005 |
| FR | 2 926 789 | A1 | 7/2009 |
| GB | 2 090 334 | A | 7/1982 |
| GB | 2 365 945 | A | 2/2002 |
| GB | 2407344 | * | 4/2005 |
| WO | WO 2004/022927 | A1 | 3/2004 |

OTHER PUBLICATIONS

Sep. 28, 2009 Search Report issued in United Kingdom Patent Application No. GB0907582.1.
Search Report issued in European Patent Application No. GB 10 16 1137 dated Oct. 7, 2010.

* cited by examiner

*Primary Examiner* — Christopher Verdier
(74) *Attorney, Agent, or Firm* — Oliff & Berridge, PLC

(57) ABSTRACT

A gas turbine engine fan casing duct wall comprises an intake section and a containment casing, provided respectively with flanges. An acoustic flutter damper is secured between the flanges. The acoustic flutter damper has a skin accommodating an internal structure that dampens fan blade flutter. The skin is secured to the flanges at separate locations. In normal operation of the engine, the internal structure is sufficiently robust to support loads transmitted through the acoustic flutter damper between the intake section and the containment casing. If a blade or blade fragment detaches, the resulting deflection wave in the containment case ruptures the internal structure, and the load path between the intake section and the containment casing passes along the skin, which consequently maintains the connection between the intake duct and the containment casing, while permitting substantial radial deflection of the containment casing relative to the intake section.

14 Claims, 4 Drawing Sheets

DUCT WALL FOR A FAN OF A GAS TURBINE ENGINE

This invention relates to a duct wall for a fan of a gas turbine engine, and is particularly, although not exclusively, concerned with a duct wall structure which minimises damage to the engine in the event of detachment of all or part of a blade of the fan.

Many current gas turbine engines, particularly for aerospace use, comprise an engine core and a ducted fan which is driven by a turbine of the engine core. The ducted fan comprises a fan rotor having an array of fan blades which rotate within a duct surrounding the fan rotor, to provide a substantial part of the thrust generated by the engine.

The duct is defined by a fan casing which has an inner wall which is washed by the gas flow through the fan and an outer wall which is a structural casing. The inner wall is a continuation of the inlet annulus and merges into the fan casing annulus at a smooth transition at the front of the fan casing.

It is known to provide measures in the fan casing to mitigate flutter of the fan blades. Flutter is a potentially damaging phenomenon in which the aerodynamic forces acting on a fan blade act together with the resilience of the fan blade to set up a torsional oscillation in the blade about its lengthwise axis. In some operating conditions of the engine, work done by the fan blades has a damping action on the torsional oscillation, causing the oscillations to decay. In other operating conditions, however, the oscillations can increase in amplitude and the resulting stresses can be very damaging to the blade.

GB 2090334 discloses one measure for damping flutter, comprising an array of tubes which are embedded in a filler material between a casing of the fan duct and an abradable material over which the fan blades pass. The tubes form cavities which are tuned to resonate at a known troublesome flutter frequency, so that, in the event of flutter arising, the resonating air in the tubes creates pressure waves which damp the flutter of the fan blades.

It is necessary for the duct casing to be able to retain, with minimum damage, all or part of a fan blade which may become detached from the fan rotor. For this reason, duct casings are provided with containment means which are intended to absorb the energy of a detached blade or fragment, and to prevent, as far as possible, the ejection of the blade or fragment outside the engine. The duct wall defining the gas flow path thus commonly comprises a containment casing provided with containment measures, situated opposite the blade tips, so that the blade tips travel over the surface of the containment casing as the fan rotates. An intake section of the duct wall is typically rigidly secured to the containment casing, and which extends forwards of the fan rotor to provide an intake duct. The intake section and the containment casing are typically interconnected by bolts, which extend through abutting flanges on the intake section and the containment casing. In a fan blade off (FBO) event, the detached blade is thrown into contact with the inner face of the containment casing with considerable energy, and continues to rotate with the fan rotor, so travelling circumferentially around the duct wall. A circumferentially travelling deflection wave runs around the containment casing, and this applies substantial stress to the bolts holding the flanges together. This creates the danger that the bolts may shear, allowing the intake section of the duct wall to become detached from the containment casing, possibly enabling it to become entirely detached from the remainder of the engine. To reduce this possibility, the containment casing may have a relatively thin wall section adjacent the flange of the containment casing, allowing the containment casing to flex at the reduced wall section, to reduce the stresses imposed on the securing bolts. Nevertheless the connection between the flanges remains rigid and so the possibility of the bolts shearing remains.

According to the present invention there is provided a duct wall for a fan of a gas turbine engine, the duct wall comprising an intake section and a containment casing, an acoustic flutter damper being disposed between the intake section and the containment casing and comprising a skin which is connected to the intake section and the containment casing at respective separate locations, whereby the skin provides a load path for transmitting loads between the intake section and the containment casing.

With such a construction, the skin may be relatively flexible by comparison with the intake section and the containment casing, so that, in an FBO event, deflection of the containment casing can be absorbed by deformation of the skin of the acoustic flutter damper so that little, if any, of the deflection is transmitted to the intake section.

The skin may accommodate an internal structure that defines passages communicating with the gas flow path through the duct. The internal structure may comprise interlocked panels, and may provide a further load path across the interior of the skin between the separate locations. The internal structure may be connected to the skin by any suitable means, such as welding.

The acoustic flutter damper may be provided with flanges disposed outwardly of the skin for connection to the intake section and the containment casing. Alternatively, the skin may be connected to the intake section and the containment casing by fasteners which extend through the skin to be secured inside the skin.

The acoustic flutter damper may be an annular component which extends around the duct wall. Alternatively, the acoustic flutter damper may comprise a plurality of segments disposed in a circumferential array around the duct wall, in which case each segment has its own respective skin.

The acoustic flutter damper, or each segment, may extend radially outwardly of the duct wall. In other embodiments, the acoustic flutter damper, so each segment, may be oriented other than radially, for example the acoustic flutter damper, or each segment, may have a first radially extending portion and a second portion which is inclined to the radial direction. In other embodiments, at least part of the acoustic flutter damper, or each segment, may extend along a portion of the containment casing, and may, for example, extend in the axial direction, or at a small angle (for example less than 10°) to the axial direction. With such a structure, the containment casing may have a radially outwardly extending flange which forms an end wall of the acoustic flutter damper.

The containment casing may comprise a perforated region which provides communication between the gas flow path in the duct and the interior of the acoustic flutter damper.

The present invention also provides a gas turbine engine comprising a fan assembly having a duct casing including a duct wall as defined above.

In this specification, references to radially and axial directions refer to the rotational axis of a fan mounted in the duct formed by the duct wall.

For a better understanding of the present invention, and to show more clearly how it may be carried into effect, reference will now be made, by way of example, to the accompanying drawings, in which:—

Figure 1:
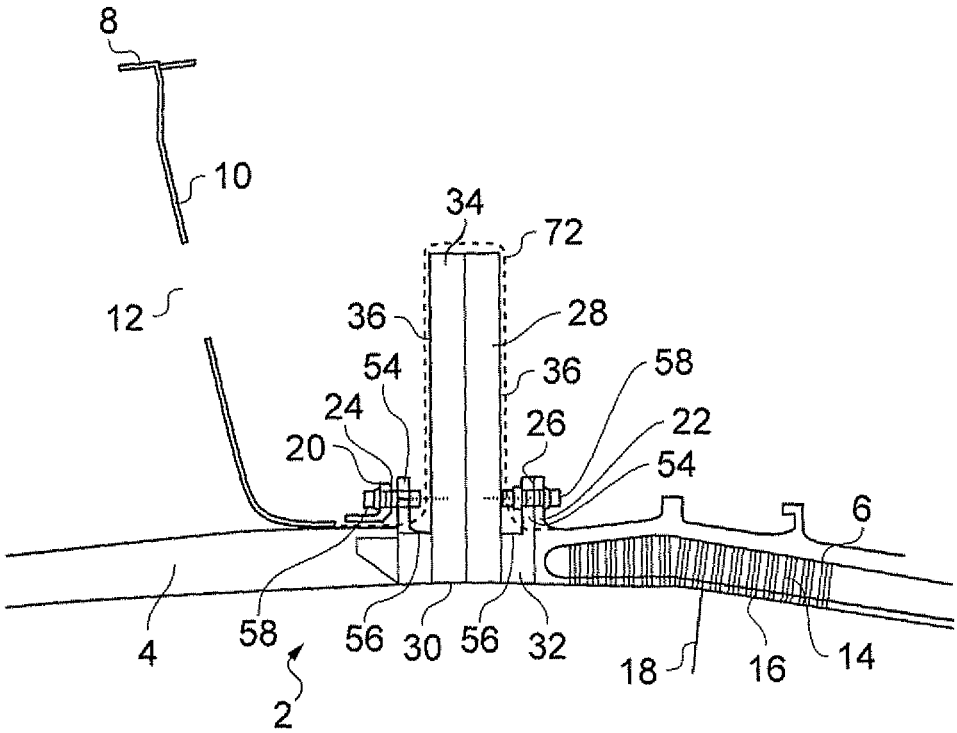
FIG. 1 is a sectional view of part of a duct casing for a fan of a gas turbine engine.

FIG. 1 shows part of a duct casing which includes a duct wall 2 comprising an intake section 4 and a containment casing 6. The intake section 4 is a twin-walled panel containing an acoustic filling (not shown) having a perforate skin on the gas-washed surface. FIG. 1 shows part of an outer nacelle cowl skin 8. The skin 8 defines the nacelle outer cowl surface and extends to the front of the duct casing (to the left in FIG. 1), and curves smoothly inwards relatively to the fan axis (which is not shown in FIG. 1 but is situated below the Figure). The skin 8 is braced with respect to the intake section 4 by a partition 10 provided with an aperture 12 for passing systems.

The containment casing 6 carries a honeycomb structure 14, which is covered by an abradable coating 16 across which fan blades, represented by a leading edge 18, sweep when the engine is operating.

The intake section 4 is provided with a flange 20, and the containment casing 6 is provided with a flange 22. The flanges 20, 22 have oppositely disposed faces 24, 26, and an acoustic flutter damper 28 is positioned between these faces 24, 26. At its radially inner end 30, the flutter damper 28 projects into an acoustic cavity 32 defined between the intake section 4 and the containment casing 6. The cavity 32 may contain an acoustic liner structure. The radially inner end 30 itself terminates flush with the gas washed surfaces of the intake section 4 and the containment casing 6.

The greater part of the radial extent of the acoustic flutter damper 28 projects radially outwardly of the flanges 20, 22. Because the acoustic flutter damper 28 is situated between the faces 24, 26 of the flanges 20, 22, the intake section 4 and the containment casing 6 are axially spaced apart from each other, rather than being directly connected together at the flanges 20, 22 as in known duct casings.

Figure 2:
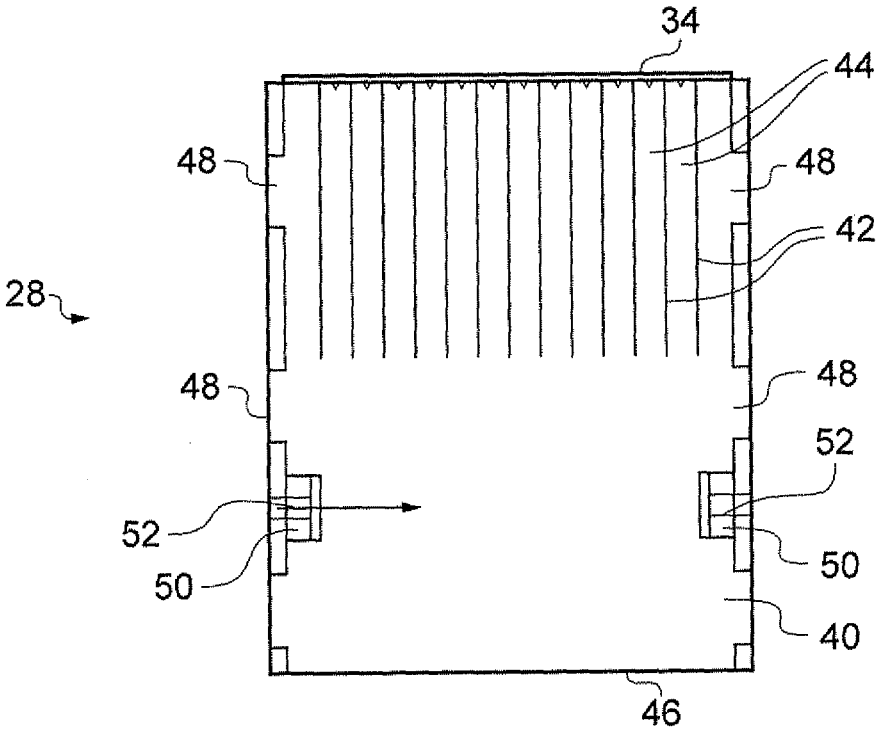
FIG. 2 is a sectional view of part of a component of the duct casing shown in FIG. 1, taken in a plane parallel to that of the Figure.

FIG. 2 is a sectional view of an acoustic flutter damper 28 of generally the same construction as that shown in FIG. 1, although of different proportions. The acoustic flutter damper 28 comprises a skin, of which only a part 34 is shown in FIG. 2. The skin part 34 extends over the radially outer end face of the acoustic flutter damper 28. The skin also comprises further parts 36 which extend over the axial end faces of the acoustic flutter damper 28 (FIG. 1), so that the skin comprises a continuous layer extending over the axial end faces and the radially outer face of the acoustic flutter damper 28.

The interior of the skin 34, 36 accommodates an internal structure which comprises an assembly of interlocking welded or brazed panels made of thin sheet material.

The internal structure comprises a first set of substantially identical panels 40, only one of which is visible in FIG. 2, and a further set of panels which extend perpendicular to the panels 40. As shown in FIG. 2, each of the panels 40 is provided with a series of thin cuts 42 (see FIG. 2) extending from the radially outer end of the panel. The other set of panels is provided with similar cuts extending from the radially inner edge, and the panels are interlocked by engaging the respective cuts of the two sets of panels so that the radially inner and outer edges of the panels lie in substantially the same plane, somewhat in the manner of a bottle divider in a case of wine. Other internal structures are possible, such as spot welded and expanded honeycomb structures.

As a result of this structure, the interlocking panels form radially-extending passages 44 which are closed at their radially outer ends by the skin part 34, and which communicate with the duct defined by the duct wall 2 through a perforated panel 46.

The panels 40 are formed at their axial edges with tabs 48 which are received in openings in the parts of the skin 34, 36 on the axial end faces 36 of the acoustic flutter damper 28, where they are plug-welded so that the panels 40 are connected between the skin parts 36.

Figure 3:
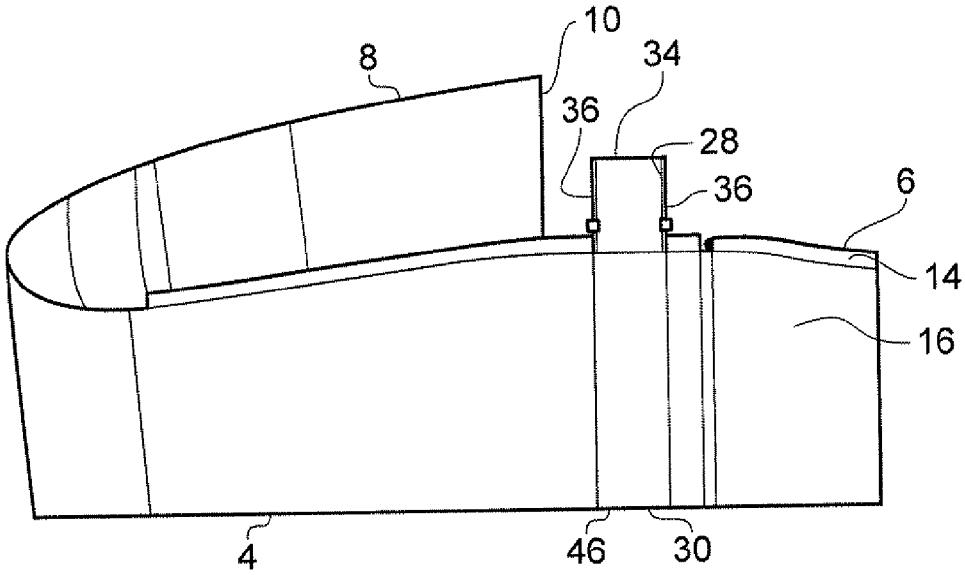
FIG. 3 is a sectional view of a variant of the duct casing shown in FIG. 1.

In the embodiment shown in FIGS. 2 and 3, reinforcing ribs 50 are fixed to the inside surfaces of the axially directed skin parts 36, which are provided with tapped bores 52.

FIG. 1 shows an alternative construction in which, instead of the ribs 50 and tapped bores 52, the acoustic flutter damper 28 is provided with flanges 54 which are secured to the outer surfaces of the axial skin parts 36 by relatively slender webs 56. The flanges 54 are clamped to the flanges 20, 22 of the intake section 4 and the containment casing 6 by fasteners 58 in the form of bolts.

In the embodiment of FIGS. 2 and 3, the acoustic flutter damper 28 is secured between the flanges 20, 22 by bolts similar to the bolts 58, engaging the tapped bores 52. However, in this embodiment, the axially facing skin parts 36 are in direct contact with the flanges 20, 22, and the acoustic flutter damper 28 occupies the entire axial space between these flanges.

In normal operation of the engine, the fan blades 18 rotate within the duct defined by the duct wall 2, with the tips of the fan blades 18 sweeping across the abradable coating 16. Acoustic noise at audible wavelengths generated by the fan is absorbed in the filling of the intake section 4 and the acoustic cavity 32. If incipient flutter develops, the fluttering blades 18 generate low frequency pressure waves which are propagated forwards, ie to the left in FIG. 1, and enter the passages 44 of the acoustic flutter damper 28 through the perforated panel 46. The pressure waves thus travel up the individual passages which are tuned, by adjustment of their length, in accordance with the expected frequency of the vibration experienced at the blades 18. When the acoustic properties of the elements are chosen correctly, the pressure waves which emanate from the acoustic element 28, and travel back towards the fan, generate an unsteady force on the fan which has the correct phase to oppose the flutter vibrations. Acoustic flutter dampers of the kind shown in the Figures are referred to as "deep liners" by virtue of the substantial length of the passages 44, by comparison with the shorter passages in the acoustic liner 4 and the cavity 32, which are accommodated in the relatively shallow space between the inner and outer skins of the intake section 4 and the front of the containment casing 6.

In normal operation, axial loading between the intake section 4 and the containment casing 6 is transmitted through the acoustic flutter damper 28. Such loading may arise, for example, on start-up of the engine, when aerodynamic effects apply a load on the intake section 4 to the left as seen in FIG. 1, tending to draw the intake section 4 away from the containment casing 6.

Because the panels 40 (FIG. 2) are connected by welding to the axially facing skin parts 36, the principal part of such axial loading is transmitted through the panels 40, which thus maintain the intake section 4 and the containment casing 6 relatively rigidly in their nominal relative axial positions.

If a fan blade 18, or a fragment of such a blade, becomes detached from the rotor, it will be impelled outwardly under centrifugal force and will pass through the abradable lining 16 into the honeycomb structure 14. Since an ejected blade or fragment will have a significant component of momentum in the circumferential direction, it will travel around the containment casing 6, generating a circumferential deflection wave of significant amplitude. In other words, the containment casing 6 is deflected radially outwardly to a substantial extent, and the flange 22 will be locally deflected relatively to the flange 20. Such an event may cause the flange 22 to be displaced axially relatively to the flange 20 with sufficient force to fracture at least some of the panels 40. This will avoid the application of the full axial loading on the bolts 58, which will remain intact.

The outer skin parts 34, 36 of the acoustic flutter damper 28 provide an alternative load path between the intake section 4 and the containment casing 6 following rupture of the internal structure (in particular, the panels 40). Consequently, the intake section 4 and the containment casing 6 remain connected together enabling the intake section 4 to be supported from the engine casing during engine run down.

In the embodiment of FIG. 1, it will be appreciated that the relatively thin webs 56 will also deflect during radial deflection of the containment casing 6, so further reducing the transmission of such deflections to the intake section 4.

By careful selection of the overall strength of the internal structure or by specific mechanical fuses including the panels 40, the acoustic flutter damper 28 can be constructed so that it will maintain its integrity under all normal operating conditions of the engine, but will fail in an FBO event, nevertheless providing an alternative load path around the skin 34, 36.

In a specific embodiment, the internal structure of the acoustic flutter damper 28 may be assembled from panels having a thickness of 0.5 mm, while the skin 34, 36 is constructed from material having a thickness of 2 mm.

The acoustic flutter damper 28 may comprise a single circumferential unit, or an assembly made from two or more segments. In one embodiment, the acoustic flutter damper 28 may be constructed as a cylindrical array of segments, for example 50 such segments, which are independently secured between the intake section 4 and the containment casing 6 by respective pairs of bolts 58.

Figure 4:
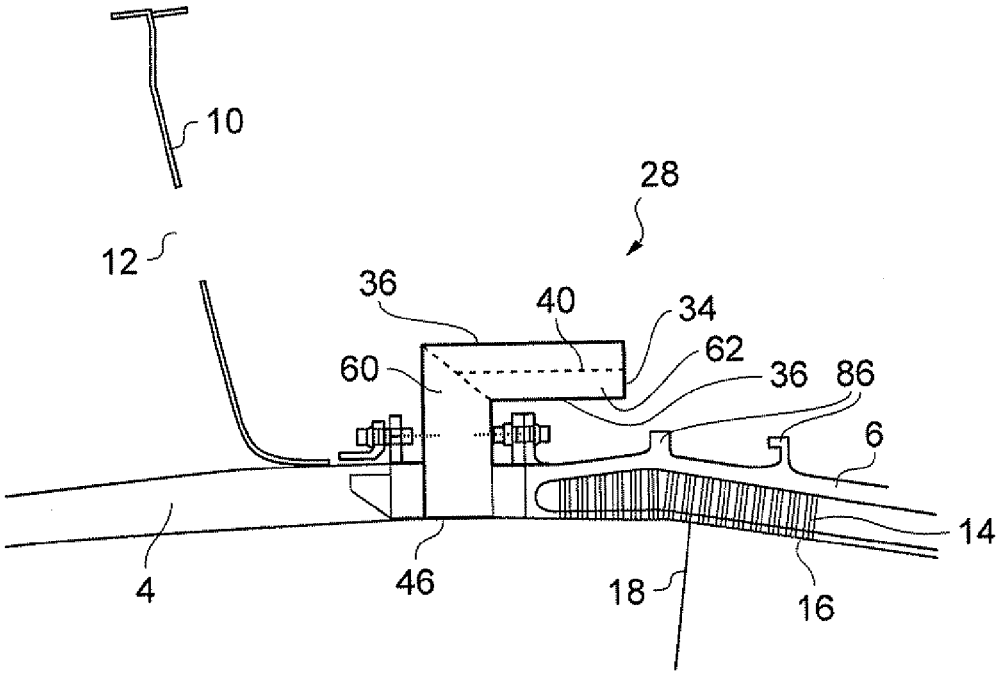
FIGS. 4 to 7 correspond to FIG. 1 but show alternative embodiments.

FIG. 4 shows an alternative configuration to that shown in FIG. 1. In FIG. 4, the acoustic flutter damper 28 is bent along its length so that it has a first section 60 which opens into the gas flow path at a perforated panel 46, and a second section 62 which extends generally axially. Such a construction reduces the radial dimension of the acoustic flutter damper 28, for example to avoid interference with ducts or other components passing through the opening 12 in the partition 10. As with the previous embodiments, the acoustic flutter damper 28 can be installed without increasing the overall engine casing length beyond that of an engine lacking the acoustic flutter damper 28. In such engines, the flange 22 of the containment casing 6 is provided on a flexible web so as to be situated directly adjacent the flange 20 on the intake section 4, the flexible web permitting a certain degree of relative radial displacement between the body of the containment casing 6 and the intake duct 4.

The bend between the section 60 and 62 of the acoustic flutter damper 28 is expected to have a minimal impact on the acoustic performance of the acoustic flutter damper 28. Furthermore, the bend enhances the radial flexibility of the load path around the skin 34, 36 to minimise the transfer of FBO loads and deflections from the containment casing 6 to the intake section 4. The structure shown in FIG. 4 also provides an enhanced axial load bearing capacity over that shown in FIG. 1.

Figure 5:
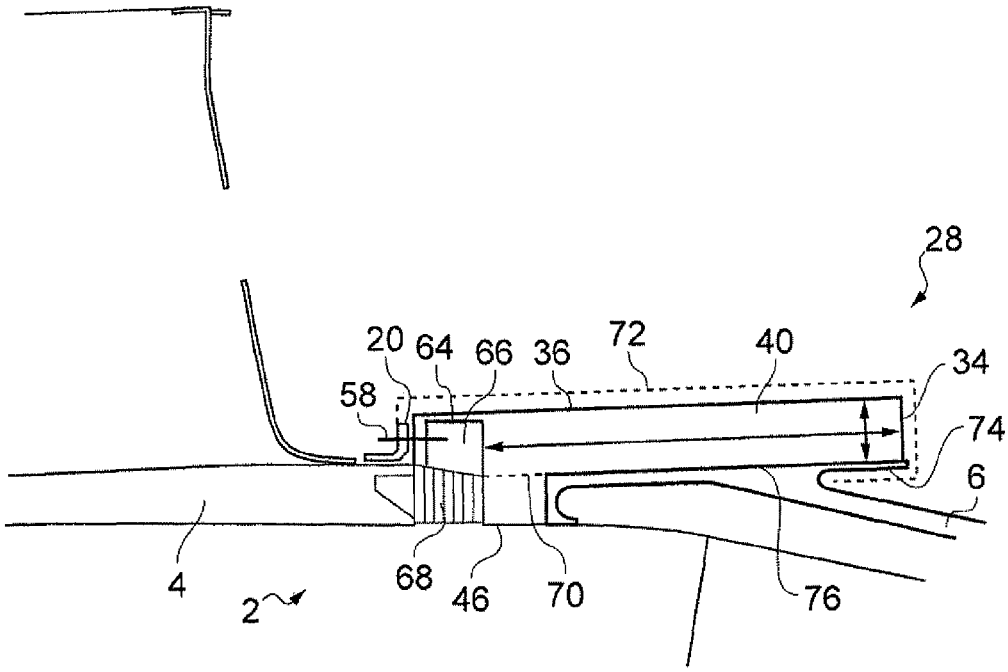

FIG. 5 shows a further variant, in which the containment casing 6 provides part of the outer wall of the acoustic flutter damper 28. In this embodiment, the skin 34, 36 has a first part 34 at the axial end of the passages 42 away from the intake of the acoustic flutter damper 28 at the perforated panel 46. The skin 34, 36 has a second part 36 which extends circumferentially around the duct wall 2. The acoustic flutter damper 28 has a forward end section 64 which provides a cavity 66 for accommodating the ends of the bolts 58. The cavity 66 is separated from the gas flow path by a block 68 of acoustic damping material.

Communication between the gas flow path and the passages 44 is achieved through the perforated panel 46 and a perforate wall 70. The perforations in the wall 70 are relatively large by comparison with the perforations in the perforated sheet 46. The perforate wall 70 may be an integral extension of the containment casing 6. The perforate wall 70 is designed to fuse under FBO.

In the embodiment of FIG. 5, the skin 34, 36 provides a load path 72, indicated diagrammatically by a chain-dotted line in FIG. 5, which transfers load via a rearwardly directed extension 74 of the containment casing 6, over the skin 34, 36 to the flange 20 on the intake section 4. Thus, in an FBO event, substantial radial displacement of the containment casing 6 relatively to the intake section 4 is accompanied by radial deflection of the axially extending skin part 36 preventing the transmission of loads to the intake part 4. In normal operation, axial loads are transmitted through the internal structure 40 of the acoustic flutter damper 28.

In the embodiment of FIG. 5, a surface 76 of the containment casing 6 provides one wall of the acoustic flutter damper 28.

Figure 6:
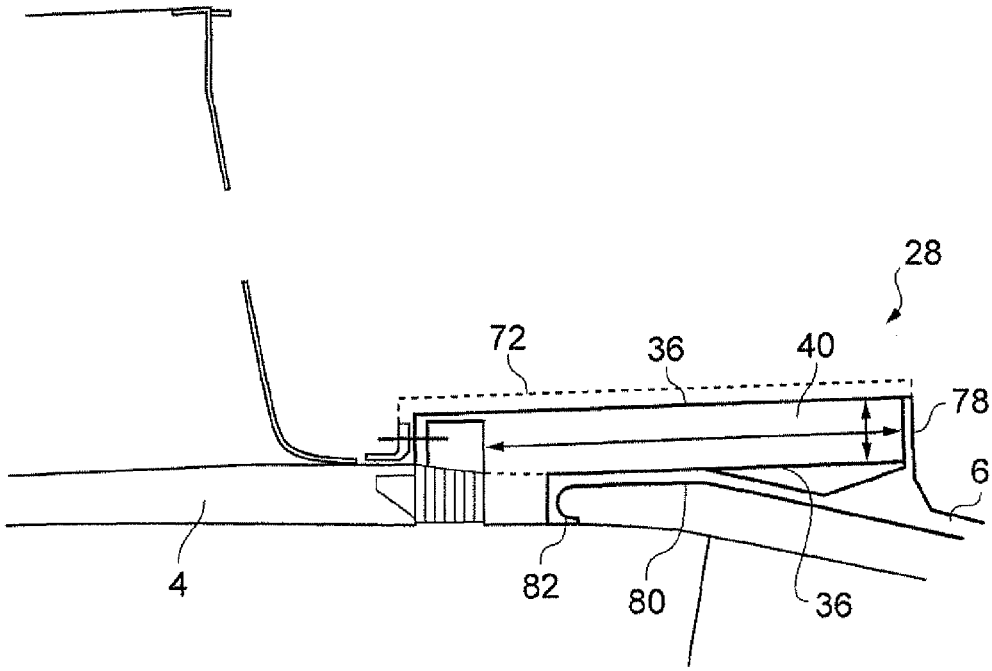

FIG. 6 shows another variant of the duct wall. The embodiment shown in FIG. 6 is similar to that of FIG. 5, although the acoustic flutter damper 28 is provided with a generally axially extending skin part 36 on each side of the internal structure, which may again comprise interlocked panels in the manner described. Also, the containment casing 6 provides a radial extension 78 which increased containment casing stiffness, and encloses the rearward end of the acoustic flutter damper 28 so that the end skin part 34 of the embodiment of FIG. 5 is omitted. Thus, the load path 72 extends from the intake section flange 20 only to the rearward end of the skin 36.

Nevertheless, the flexibility of the skin 36 is maintained, avoiding the transmission of excessive loads and displacements from the containment casing 6 to the intake section 4.

The embodiment of FIG. 6 provides a reduced weight of the containment casing 6 compared with that of FIG. 5, since the acoustic flutter damper 28 does not need to be supported along its entire length by the surface 76. Instead, the containment casing 6 has a relatively slender extension 80 which supports part of the radially inner region of the skin 36 and a fan blade hook 82.

Figure 7:
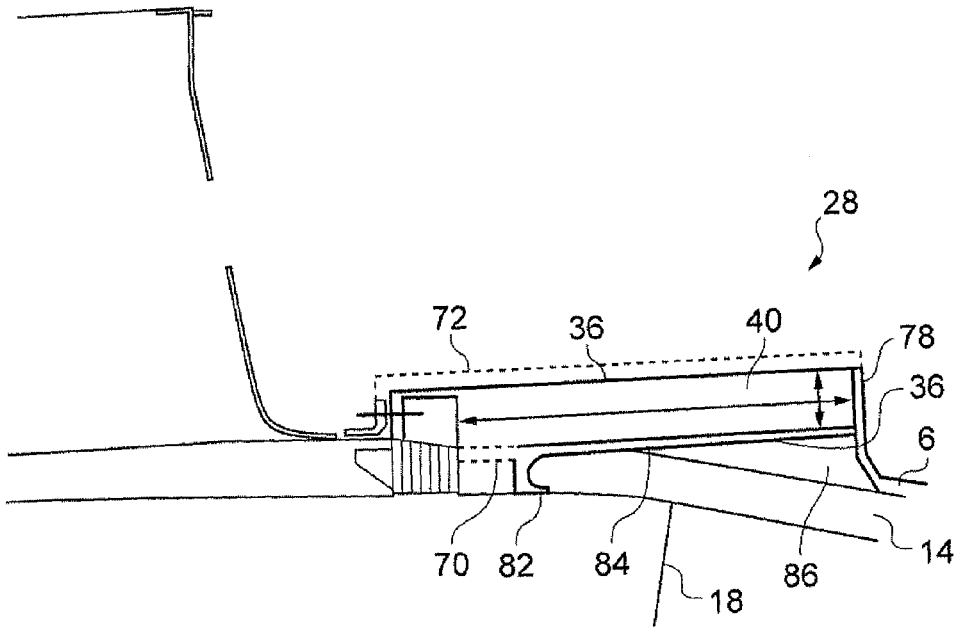

FIG. 7 shows an alternative variant, in which the containment casing 6 has a slender extension 84 which extends from the radial flange 78 to the fan blade hook 82, supporting the radially inner region of the skin 36 over substantially its entire length. The extension 84 is extended beyond the blade hook 82 as the perforated wall 70.

The embodiment of FIG. 7 provides additional space 86 for receiving a detached "windmilling" blade 18. Also, the additional space 86 provides additional capacity for blade capture and acoustic damping. The space may be filled with an acoustic material, for example of honeycomb form, which is crushed by a detached blade or blade fragment so as to absorb energy from the blade or blade fragment and to provide safe containment of debris.

The present invention thus provides an acoustic flutter damper structure which is capable of withstanding normal loads between the intake section 4 and the containment casing 6, yet can deform, owing to the flexible skin 34, 36, in the event of major radial deflections of the containment casing 6 under an FBO event. The positioning of the acoustic flutter damper 28 at the junction between the intake section 4 and the containment case 6 provides good acoustic damping performance, owing to the proximity of its intake at the perforated panel 46 to the blades 18. The skin 34, 36 is made of relatively thin material, in order to provide the required flexibility, and consequently represents a weight saving over traditional designs with benefits to the intake design load cases. The structure of the acoustic flutter damper 28 also provides a mechanism for module separation for ease of maintenance.

In the embodiment of FIG. 5, some components of the acoustic flutter damper 28, for example the internal structure 40, can be incorporated as part of the structure of the containment casing 6, so reducing the part count and weight of the assembly.

The flexible skin 34, 36 can provide a load path 72 which is adjustable by modifying the design of the acoustic flutter damper 28, for example to provide a bend between the section 60 and 62 in the embodiment of FIG. 4. The flexibility of the skin 34, 36, and the consequent reduction in FBO loads transmitted from the containment casing 6 to the intake section 4 means that the bulk of the flanges 20, 22 can be reduced and yet withstand a given deflection of the containment casing 6. Also the intake structure can be designed to benefit from the reduction in transmitted loads. Alternatively, existing flange designs can tolerate greater deflections of the containment casing 6.

By appropriate design of the internal structure 40 and the flexible skin 34, 36 of the acoustic flutter damper 28, the acoustic flutter damper 28 can withstand loads imposed during normal operation, so maintaining the relative positioning of the intake section 4 and the containment casing 6. Under FBO loads, the initial load path will fail, so that support between the intake section 4 and the containment casing 6 is transferred to the flexible skin 34, 36 of the acoustic flutter damper 28.

Positioning the acoustic flutter damper 28 radially outboard of the containment casing 6 avoids increasing the overall length of the fan casing without requiring a reduction in the length of the acoustic layer 14. The acoustic damping effect of the acoustic flutter damper 28 can make it possible to avoid incorporating an acoustic liner in the intake section 4, ahead of the junction between the intake panel 4 and the containment casing 6.

In the embodiments of FIGS. 6 and 7, the radial flange 78 enhances the rigidity of the containment casing 6, so making it possible to avoid separate stiffening ribs such as those indicated at 86 in FIG. 4.

The present invention, by reducing the loads applied to the bolts 58 in an FBO event, make it possible to avoid other measures for relieving stress on these bolts, for example by means of collapsible collars. Furthermore, the crushing or rupturing of the internal structure 40 of the acoustic flutter damper 28 provides an effective mechanism for absorbing the energy released during an FBO event.

The invention claimed is:

1. A duct wall for a fan of a gas turbine engine, the duct wall comprising an intake section and a containment casing, an acoustic flutter damper being disposed between the intake section and the containment casing such that the intake section and containment casing are axially spaced, the acoustic flutter damper comprising a skin which is connected to the intake section and the containment casing at respective separate locations whereby the skin provides a load path for transmitting loads between the intake section and the containment casing.

2. A duct wall as claimed in claim 1, wherein the skin accommodates an internal structure which defines passages communicating with the gas flow path through the duct.

3. A duct wall as claimed in claim 2, wherein the internal structure comprises interlocked panels.

4. A duct wall as claimed in claim 2, wherein the internal structure is connected to the skin by welding.

5. A duct wall as claimed in claim 1, wherein the acoustic flutter damper is provided with flanges disposed outwardly of the skin for connection to the intake section and the containment casing.

6. A duct wall as claimed in claim 1, wherein the skin is connected to the intake section and the containment casing by fasteners extending through the skin.

7. A duct wall as claimed in claim 1, wherein the acoustic flutter damper comprises an annular component extending around the duct wall.

8. A duct wall as claimed in claim 1, wherein the acoustic flutter damper comprises a plurality of segments disposed in a circular array around the duct wall.

9. A duct wall as claimed in claim 1, wherein the acoustic flutter damper extends radially outwardly of the duct wall.

10. A duct wall as claimed in claim 1, wherein the acoustic flutter damper comprises a first radial portion and a second portion which is inclined to the radial direction.

11. A duct wall as claimed in claim 1, wherein at least part of the skin extends along a portion of the containment casing.

12. A duct wall as claimed in claim 11, wherein the containment casing has a radially outwardly extending flange engaging an end of the acoustic flutter damper.

13. A duct wall as claimed in claim 1, wherein the containment casing comprises a perforated wall providing communication between the gas flow path in the duct and the interior of the acoustic flutter damper.

14. A gas turbine engine comprising:

a duct wall as claimed in claim 1; and a fan assembly having a duct casing including the duct wall.

* * * * *